US008136626B1

(12) United States Patent
Aliev

(10) Patent No.: US 8,136,626 B1
(45) Date of Patent: Mar. 20, 2012

(54) MOBILE SOUNDPROOF ENCLOSURE WITH CHANGEABLE ROOM GEOMETRY AND OPTIONAL VENTILATION NOISE CANCELLING DEVICE

(76) Inventor: Adil Aliyevich Aliev, Jefferson, MD (US)

( * ) Notice: Subject to any disclaimer, the term of this patent is extended or adjusted under 35 U.S.C. 154(b) by 0 days.

(21) Appl. No.: 13/017,042

(22) Filed: Jan. 30, 2011

(51) Int. Cl.
*A47B 81/06* (2006.01)

(52) U.S. Cl. ..... 181/198; 181/200; 181/208; 181/210

(58) Field of Classification Search ..... 181/198, 181/200, 208, 210
See application file for complete search history.

(56) References Cited

U.S. PATENT DOCUMENTS 1,966,288 A * 7/1934 Foltz ..... 454/237
3,611,907 A * 10/1971 Wasserman et al. ..... 454/186
3,905,444 A * 9/1975 Evans, Jr. ..... 181/200
3,935,923 A * 2/1976 Wheeler ..... 181/200
3,951,228 A * 4/1976 Schnell ..... 181/200
4,942,938 A * 7/1990 Wiegel ..... 181/30
5,123,874 A * 6/1992 White, III ..... 454/251
5,525,765 A * 6/1996 Freiheit ..... 181/30
5,530,211 A * 6/1996 Rogers et al. ..... 181/30
5,646,378 A * 7/1997 Van Haaff et al. ..... 181/30
5,651,405 A * 7/1997 Boeddeker et al. ..... 160/135
7,815,011 B2 * 10/2010 Holzman et al. ..... 181/30
7,918,312 B2 * 4/2011 Carlson ..... 181/287

* cited by examiner

*Primary Examiner* — Forrest M Phillips

(57) ABSTRACT

Mobile soundproof enclosure with changeable internal room shape and optional ventillation noise cancelling device consisting of a frame that can be assembled and disassembled by a single person without using tools and that in disassembled state is small enough to fit in a trunk of a car; a cover made with flexible sound absorbent sheet material creating completely enclosed room with double walls with air space in between, corner sound traps made with flexible sound absorptive sheet material that can be individually positioned to change internal shape of the room and an air vent noise cancelling device made with flexible sound absorbing sheet material having inlet portion, which enters a center portion at an angle, the center portion larger than the inlet portion and outlet portion which exits the center portion at an angle; the whole enclosure can be disassembled to compactly fold for easy storage or transportation.

18 Claims, 8 Drawing Sheets

MOBILE SOUNDPROOF ENCLOSURE WITH CHANGEABLE ROOM GEOMETRY AND OPTIONAL VENTILATION NOISE CANCELLING DEVICE

BACKGROUND OF THE INVENTION

The present invention relates generally to the field of sound attenuation devices and systems, and more particularly to portable sound proof booths that can be easily assembled and disassembled. Soundproof enclosures or sound booths, are required for recording vocalists, tracking bands, acoustic instruments, and voice over work as well as practicing, rehearsing and instructional use, for creating an environment where sound can be controlled.

One objective that must be achieved by using a sound booth is to stop sound from entering or leaving a space, or soundproofing. That is, to prevent sound from disturbing the neighbors, and to keep the outside noise from disturbing an artist and/or getting into recordings.

The other objective is to enhance the properties of sound by improving speech clarity and sound quality, which requires acoustic room treatment. There are three primary goals of acoustic treatment: 1) To prevent standing waves and acoustic interference from affecting the frequency response of recording studios; 2) to reduce modal ringing in small rooms; 3) to absorb or diffuse sound in the room to avoid ringing and flutter echoes.

Sound in an enclosed space behaves fundamentally different from sound in a free field. In most enclosed spaces sound from the source is reflected from boundary surfaces such as walls, floor and ceiling. The resulting sound-pressure level at any point in the enclosure is a combination of direct sound and the reflective sound. The worst type of room shape is a perfect cube, because all three dimensions are the same and all three dimensions resonate at the same frequency, furthermore the corners of the room build up the most bass energy under steady-state conditions. Therefore, the goal is to have a room shape that spreads the modes evenly throughout the low frequency range. This is done by designing the room with dimensions whose ratios of length, width, and height are as unrelated as possible.

While these factors can be addressed in stationary sound booths built by professional sound engineers, those booths are very expensive and it can only be rolled within a limited distance.

Therefore there is a need for high quality low cost mobile booths with good acoustic qualities, that can be taken out in the field, can be assembled and disassembled by a single person as many times as needed, and can be transported in an average size car, or simply be put up to use in an apartment, and be dismantled and stored when not in use.

All enclosures require adequate ventilation, which is in most cases achieved by forced air ventilation. The air rushing through air ducts carries with it noise from a fan and the air velocity itself may cause noise. This creates yet another objective: to quiet the air flow and cancel the noise carried by the air.

Achieving these objectives requires a multifaceted approach.

Giordano (Pub No.: US 2005/0284079 A1, application Ser. No. 10/794,106 filing date Mar. 4, 2004) described a method of constructing sound booth out of readily available ½ inch metal conduits as an alternative way of building inexpensive sound booth. This method is widely discussed on internet forums as a Do-It-Yourself (DIY) project. Giordano does not describe a new product he describes a method. The deficiency of Giordano's desighn is that it still has plurality of small parts that can be easily lost, and tools are required for assembly/disassembly; also the frame is not designed for repeated assembly/reassembly. Another deficiency is that although the author calls his invention "sound booth" he does not describe any special sound barrier solutions, but limits his description solely to assembly of the frame. On the other hand his booth supposed to be covered only "on its two side and back panels", which does not provide complete enclosure from all sides and does not create an adequate sound proof environment. Other existing "walk in" sound booths are pretty much permanent bulky structures that once built cannot be easily disassembled/reassembled and transported by passenger cars.

BRIEF SUMMARY OF THE INVENTION

The present invention has been developed in response to the present state of the art, and in particular, in response to the problems and needs in the art that have not yet been fully solved by currently available portable sound booths. Accordingly, the present invention has been developed to provide a truly mobile soundproofing enclosure with optimal acoustic room treatment.

The primary object of the invention is to make it truly mobile and be easy to assemble and disassemble by a single person in a field, in a hotel room or an apartment, for musical practice, voice over recordings and such. A further object of the invention is that it can be easily disassembled and frame can be folded away in a bag for storage when not in use, where the volume of the bag with the frame is small enough to fit in a trunk of a car for easy transportation. This objective is achieved by designing a light weight frame with parts not exceeding the length of a trunk of a midsize car. The connectors of the frame are designed to be attached to straight pieces and be locked in place to avoid having small parts, such as nuts and screws.

Another object of the invention is that it is made with flexible sound absorptive sheet material and the whole enclosure can be easily disassembled and folded into compact packages to fit in a car or a closet. The invention in its preferred embodiment is designed to be completely covered with the sound absorptive material, but at the same time each section of it, such as top or any one or more side walls, can be removed if so desired. The invention in its preferred embodiment has plurality of double walls made out of sound absorbing material, such as acoustic blanket, with airspace between the layers. Optionally that airspace can be filled with additional soundproofing material, such as rockwool, to further improve soundproofing. This objective is achieved by using flexible sound absorptive sheet material, such as quilted blankets, for constructing the walls and the top.

Yet another object of the invention is that it has corner sound traps that serve to absorb low frequence sound wave and adjust the internal geometry of the enclosure. By changing the position of corner sound traps the internal shape of the enclosure can be converted from symmetrical to asymmetrical and vice versa creating a room with dimensions whose ratios of length, width, and height can be made unrelated. This objective is achieved by using the corner sound traps with extendable corner bars with swivelling brackets, which can be positioned independently and unrelated to each other.

A further object of the invention is to have ventilation noise cancelling device that would reduce the noise coming from ventilation source by changing direction of the airflow, reducing the speed of the air flow and absorbing the noise coming directly from the ventilator. Such device also has to be foldable to reduce volume for transportation. These objectives were acheved by designing a Ventilation noise cancelling device made with flexible sound absorbing sheet material, where an inlet portion enters a central portion at an angle, and the central portion is wider that the inlet portion. An outlet portion is of larger diameter than the inlet portion and is leaving the central portion at an angle.

Other objects and advantages of the present invention will become apparent from the following descriptions, taken in connection with the accompanying drawings, wherein, by way of illustration and example, an embodiment of the present invention is disclosed.

In accordance with the preferred embodiment of the invention, there is disclosed a mobile soundproof enclosure with changeable internal room shape and optional ventilation noise cancelling device comprising:

a) a light weight frame that can be assembled and disassembled without using tools by a single person and, in disassembled state, is small enough to fit in a trunk of a car;

b) a cover made with flexible sound absorbent sheet material, that is, when placed on the frame, creates a completely enclosed room, having plurality of double walls with air space between the layers, which may be filled with additional soundproof material. When the enclosure is not in use, the cover can be taken off the frame and folded for storage or transporting in a stack small enough to fit in a car;

c) corner sound traps, made with flexible sound absorptive sheet material, which can be positioned in various ways to change internal shape of the room;

d) an air vent noise reduction device, made with flexible sound absorbing sheet material, having an inlet portion, entering a center portion at an angle, where the center portion is larger than the inlet portion, and having the outlet portion exiting the center portion at an angle.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
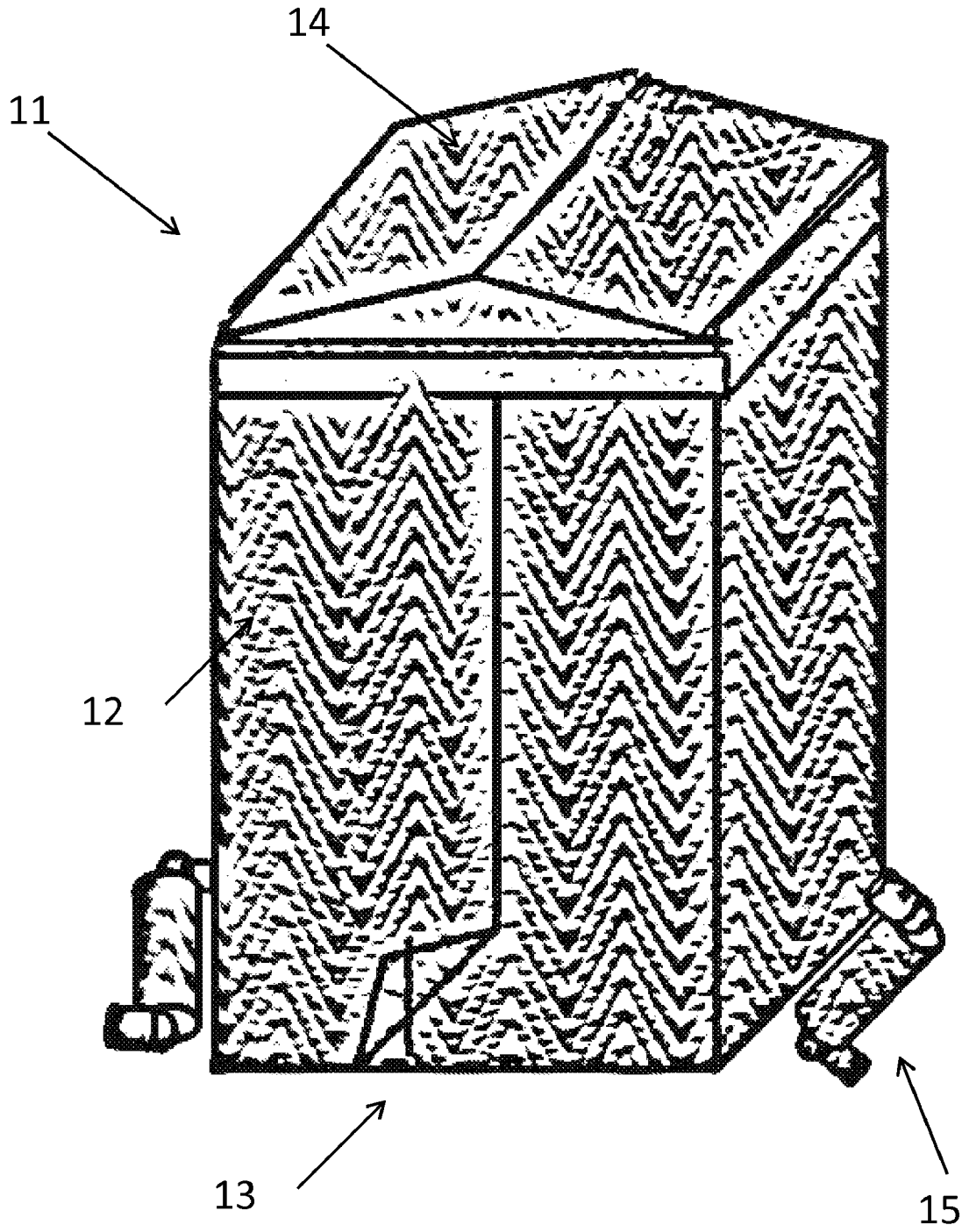
FIG. 1 is a perspective view of the invention.

Referring to FIG. 1 there is shown a perspective view of an assembled soundproof enclosure 11, with wall covers 12 made out of flexible soundproofing sheet material, such as acoustic blanket, covering all four walls, with entrance 13 on one side, and top cover 14, made out of the same or other suitable soundproofing material. Ventilation noise cancelling device 15 is attached to at least one side of the enclosure to muffle sound coming from incoming and/or outgoing ventilation fan.

Figure 2:
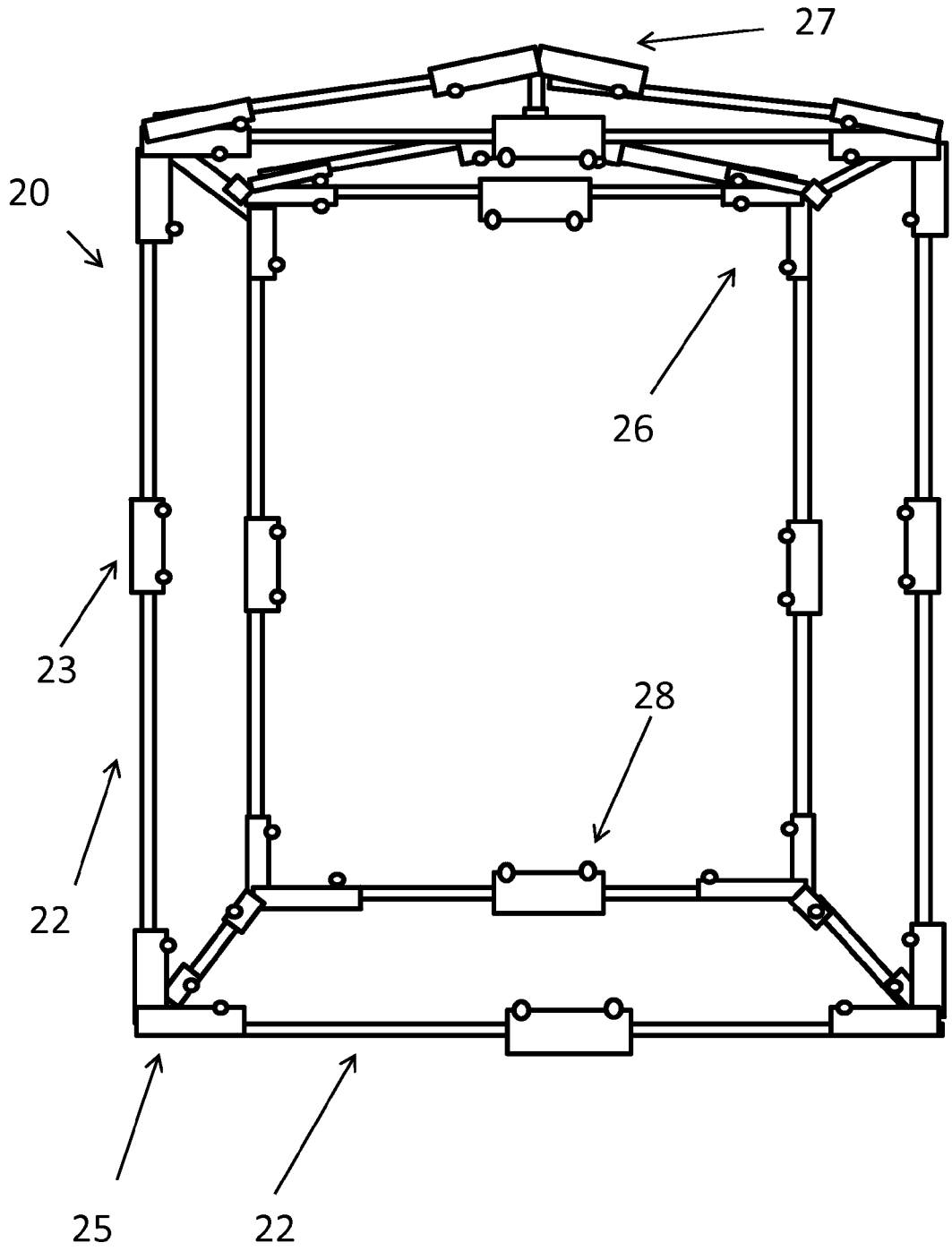
FIG. 2 is a diagrammatical front view of the frame of the enclosure in assembled state with cover removed.

Referring now to FIG. 2 there is shown a diagrammatic view of the frame 20, which supports the said soundproof wall covers 12 and top cover 14. Use of readily available PVC or aluminum conduit pipes to build a frame for a sound booth is known in prior art and widely used by DIY enthusiasts. What is new in this invention is that straight pieces 22 are cut to the length to fit in a trunk of a car and the whole frame has no small parts, like screws and nuts. To simplify assembly, straight pieces 22 are preferrably of the same size and in assembled frame they are connected to each other by straight connectors 23 and corner connectors 25, 26, 27 with built in "ball-lock" 28. This design allows an easy assembly and disassembly of the frame multiple times by a single person, without necessity to use any tools and in order to have minimum of small parts.

In the preferred embodiment frame 20 comprises a number of straight pieces 22 and various types of connectors, such as straight connector 23, corner 90 degrees 3 piece "Y" connector 25, 4 piece low angle corner connectors 26 and low angle top "Y" connectors 27. All connectors attach to the straight pieces by a ball-lock 28. It is obvious though, that the straight pieces may be made of different sizes and connections can be of any other suitable design, such as screw and nut, welded-on nuts with bolts, direct threaded screw-on connections or a plain fitted connection. In the preferred embodiment fitted connectors with ball-lock provide universal fit of the parts, simplify assembly and at the same time provide extra stability and security of the frame by locking parts in place.

It should also be obvious that the shape of the frame and specifically the top portion of it can vary. In the preferred embodiment we use pitched roof design, because it provides for stronger support for the top cover and ability to hang off the frame light-weight accessories, such as lights, wires or additional sound traps. On the other hand pitched top design keeps flexible soundproofing cover from sagging down and maintains proper shape.

Figure 3B:
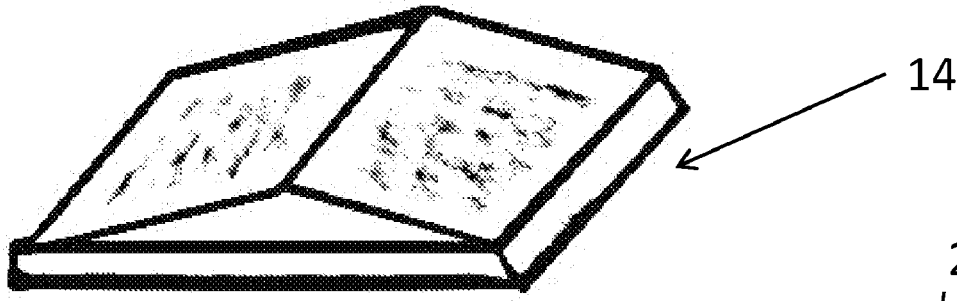
FIG. 3B is a view of cross section of the side wall of the preferred embodiment of the invention showing two wall layers.
Figure 3B:
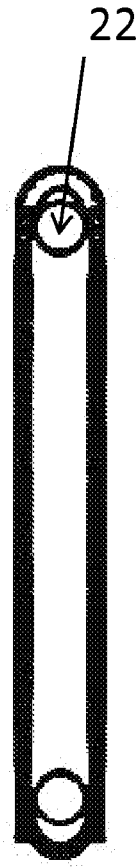
Figure 3A:
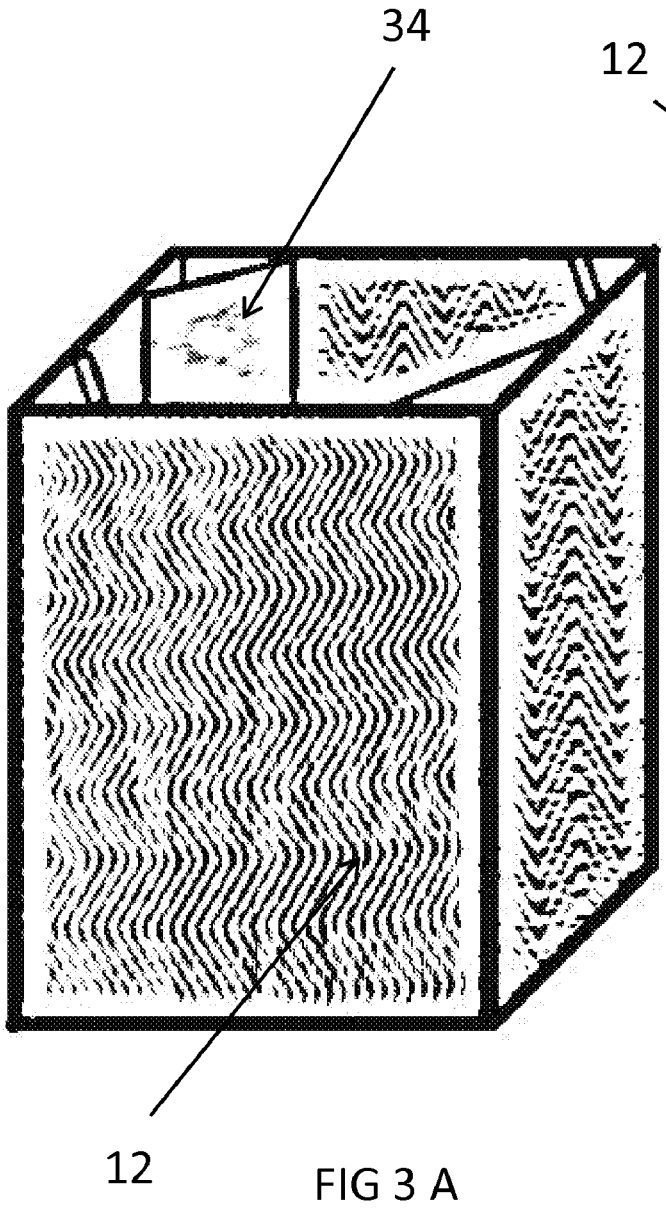
FIG. 3A is a general view of the invention with top part lifted and corner sound traps partially visible.

Referring now to FIG. 3A there is shown the invention with top cover 14 lifted and top portion of the frame removed to expose the shape changing corner sound traps 34 inside the enclosure. The walls 12 may be installed all at once to achieve fully enclosed room or in any combination to have partially enclosed space, so the resulting enclosure may have only one, two, three or four walls with or without top. Corner sound traps are known in the prior art and usually being called Bass Traps, because they are designed to absorb low frequency sound waves standing in the corners. The said Bass traps, are usually stand alone items or bags, made out of sound absorbing material. The difference of the corner sound traps of this invention is that the corner sound traps 34 stretch from top to bottom in the corner of the enclosure and hang off the top of the side wall 12. The novelty of the corner sound traps of this invention is that the position of each corner trap can be changed individually and therefore the configuration of the whole room is changeable, which is very important for managing sound reflections. The corner sound traps 34 can be positioned at a different angle in relation to the walls 12, which changes the inside shape of the room and allows for better sound diffusion. Corner sound traps 34 are removable and can be used all at once, individually or in any combination.

Referring now to FIG. 3B, there is shown a diagrammatical cross sectional view of the wall 12. In the preferred embodiment the wall 12 is a two layer cover stretched between the upper and lower sides of the frame 20.

Research shows that the best sound attenuation is achieved when sound has to go through mediums with different density and building a "room-within-a-room" enclosure is the best way to achieve this effect. Stationary vocal booths and recording studios are often built using this principle, but it is a novelty in the portable booth application. The double wall construction of the sound enclosure of the present invention provides the effect of "room-within-a-room" construction where two walls are separated by air space. That inside air space between two outer layers can be filled with additional soundproofing materials such as rock wool or mass loaded vinyl, if so desired. It should be obvious that a single layer or multiple layer wall cover design is also possible.

Figure 4:
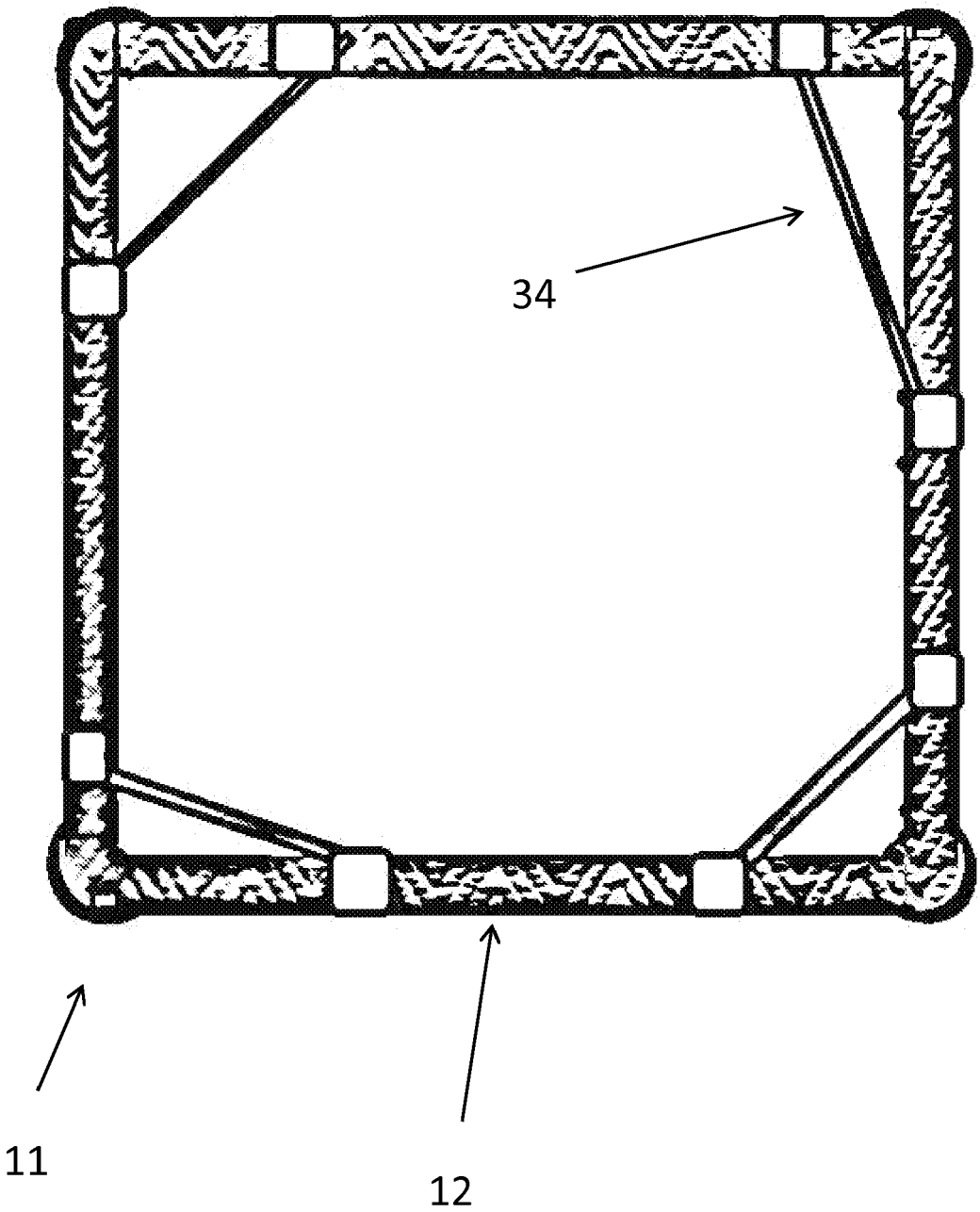
FIG. 4 is a schematic top view of the invention with top portion removed, showing possible positioning of the corner sound traps.

Referring now to FIG. 4 there is shown a schematic top view of the invention with top cover and top portion of the frame removed to demonstrate the use of shape changing corner sound traps 34. Corner sound traps 34 are hanging on walls 12 and can be positioned at different angles. The position of each corner sound trap 34 can be set closer to the corner or further away, therefore changing the internal geometry of the room from rectangle to an odd shape space, whichever is preferable for better sound diffusion.

Figure 5A:
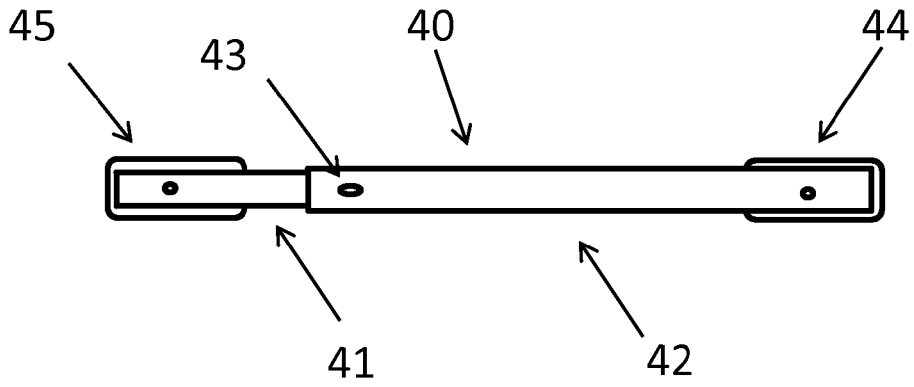
FIG. 5A is a diagrammatical top view of the extendable corner bar.

The corner sound traps 34 may be placed on the walls 12 in variety of methods. Referring now to FIG. 5A there is shown a diagrammatical top view of an extendable corner bar 40 comprising of an inner piece 41 and outer piece 42, where the inner piece 41 fits inside the outer piece 42 on one side and can be extended telescopically and fixed in the extended state with ball-lock 43. At the other end of each piece there are swiveling brackets 44 and 45 accordingly, connected to the pieces 41 and 42 by screws 46 and 47 in a way that they can freely rotate around said screws.

Figure 5B:
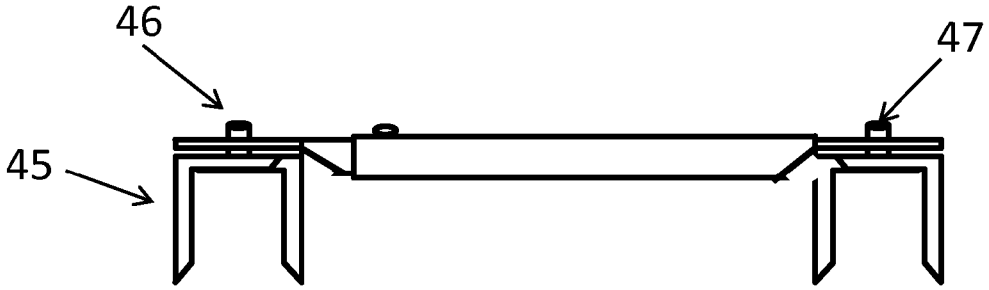
FIG. 5B is a diagrammatical side view of the corner bar contracted.
Figure 5C:
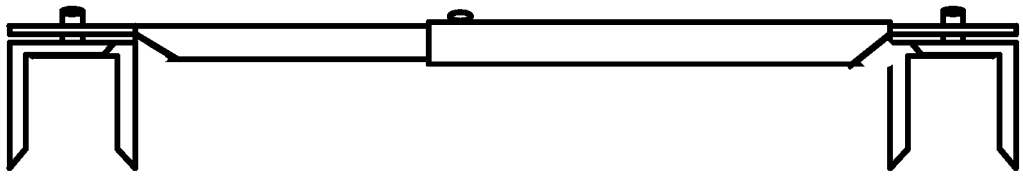
FIG. 5C is a diagrammatical side view of the corner bar extended.

FIG. 5B and FIG. 5C show diagrammatical side view of the said extendable corner bar in contracted state (FIG. 5B) and in the extended state (FIG. 5C).

Figures 6A, 6B:
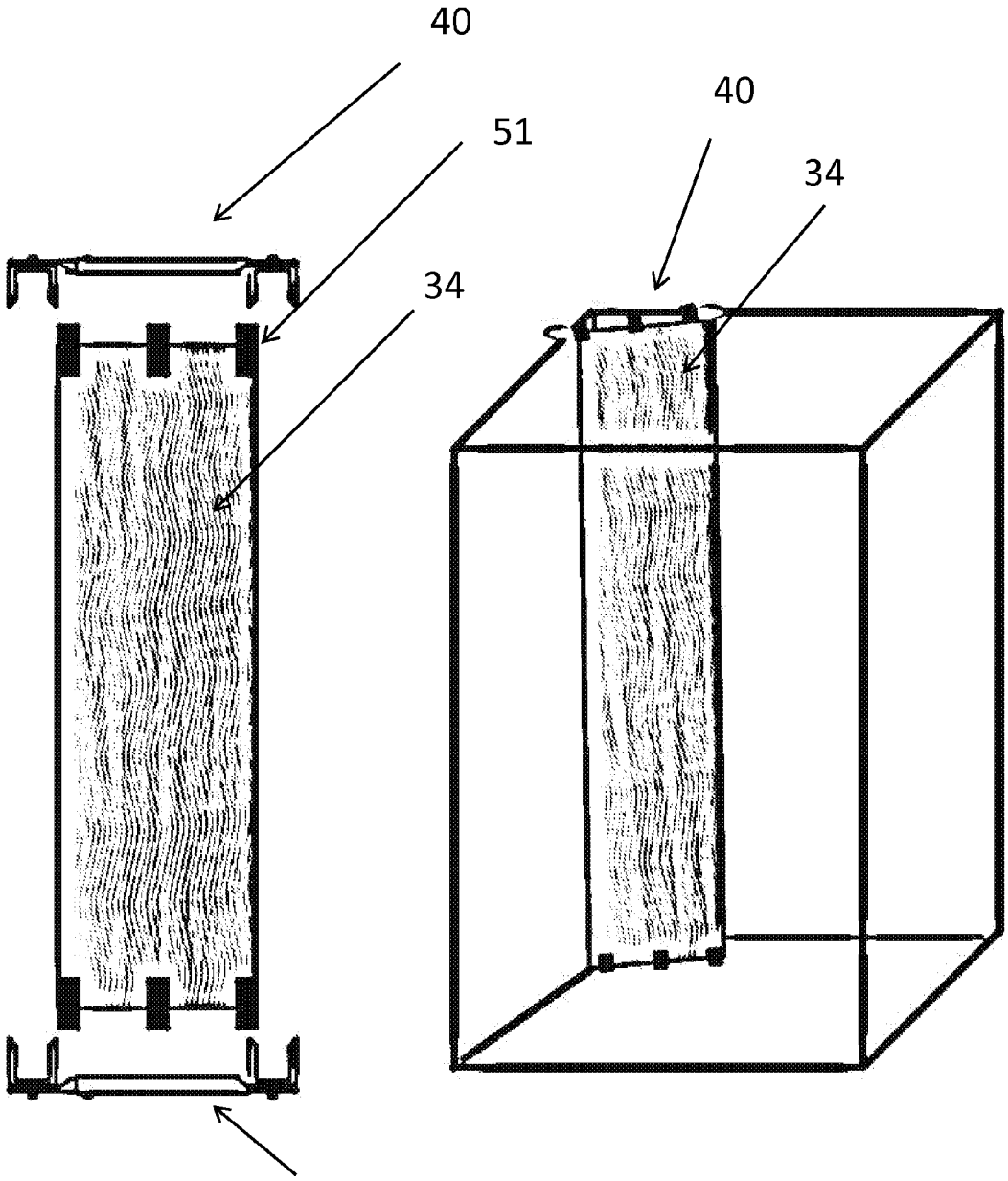
FIG. 6A is a perspective view of the corner sound trap for use with extendable corner bars.
FIG. 6B is a diagrammatical presentation of the method of using the corner sound traps with extendable corner bars.

Referring now to FIG. 6A there is shown the corner sound trap 34 that may be attached to the corner bar 40 by means of Velcro straps 51, or by tie ups, or sleeves, or any other suitable attachment. Corner sound trap can also be made as double wall construction, where the strip of sound absorbing material is folded over the top bar and fixed together on the bottom bar. On FIG. 6B shown corner sound trap 34 installed using corner bar 40.

Figure 7A:
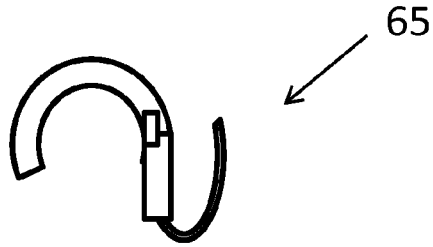
FIG. 7A is a diagrammatical view of an S-hook.
Figure 7B:
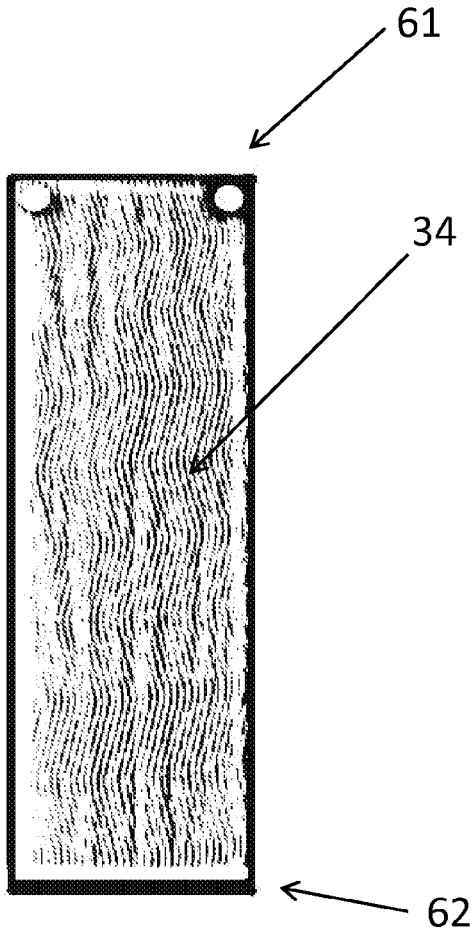
FIG. 7B is a perspective view of the corner sound trap for using with S-hooks.
Figure 7C:
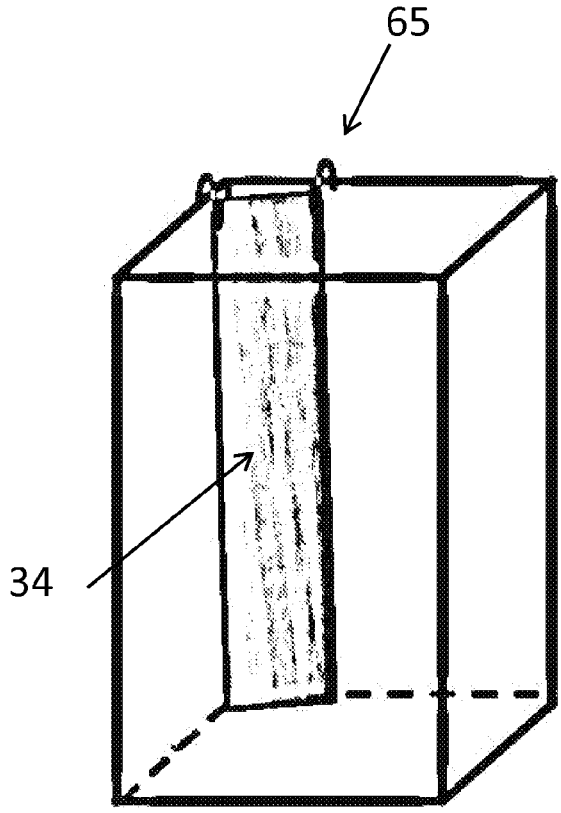
FIG. 7C is a diagrammatical presentation of method of using the corner sound traps with S-hooks.

Referring now to FIGS. 7A-7C there is shown an alternative method of installing the corner sound traps 34 with hooks 65. Where FIG. 7A shows an S-hook 65, FIG. 7B shows corner sound trap 34 with grommets 61 and weight bar 62. FIG. 7C shows the corner sound trap 34 installed using S-hooks 65.

Alternatively bracket-clips can be used to hold corner traps in place.

Figure 8:
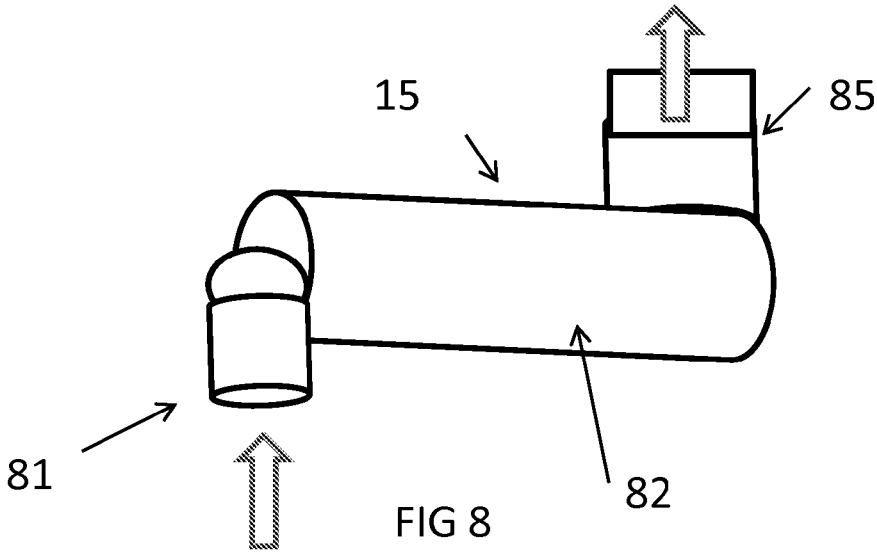
FIG. 8 is a diagrammatical view of the ventilation noise cancelling device.

Referring now to FIG. 8 there is a diagrammatical general view of the ventilation noise cancelling device 15, made out of flexible sound absorbing material, such as blanket, comprising inlet 81 entering central body 82 at an angle and outlet 85 exiting body 82 on the opposite end at an angle. Rigid rings and/or rods may be used to keep the shape of the body 82 open. In the preferred embodiment of the invention the diameter of the central body 82 is larger than diameter of the inlet 81. Arrows represent the direction of the airflow through the ventilation noise cancelling device 15. Air coming from a fan into the inlet 81 enters wider body 82 at an angle which changes direction of the air flow and absorbs noise transferring from the fan itself. Diameter of the body 82 is wider than the diameter of the inlet 81 which reduces the speed of the air flow, further reducing the noise generated by the air movement itself. Air, exiting out of the outlet 85, would then move at the reduced speed and noise coming from the ventilation source such as fan will be reduced both by changing the speed and direction of the air flow and by absorbing noise by the material of the device 15. The novelty of the design is that the device 15 is made of the flexible sound absorbing material that can be folded away for easy transportation and storage, and it acts in two ways at the same time: it and the air flow goes from smaller inlet to a larger diameter outlet, which reduces the speed of the air flow and walls of the device are absorbing the noise at the same time.

Figure 9:
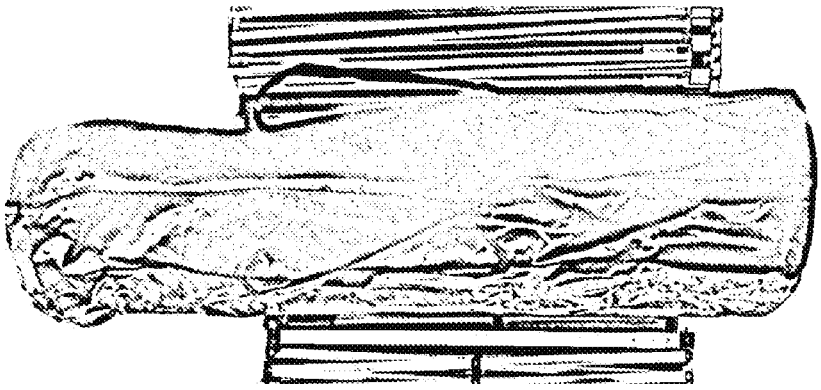
FIG. 9 is a general view of the disassembled frame, folded away in a carry bag.
Figure 10:
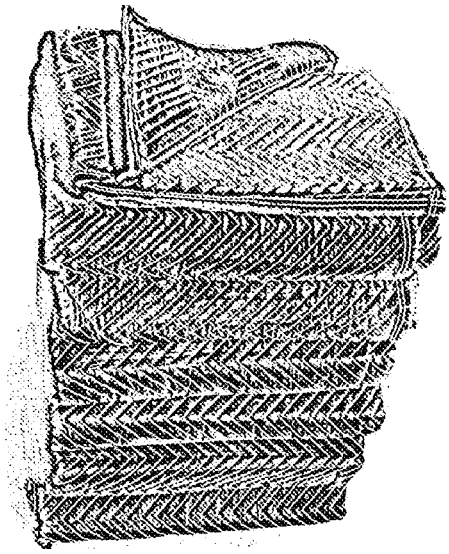
FIG. 10 is a general view of the folded cover including walls, top, corner traps and noise cancelling device.

Referring now to FIG. 9 there is shown a general view of the frame 20 disassembled and packed in a carry bag Referring now to FIG. 10 there is shown a stack of flexible soundproofing covers folded for storage or transportation.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A mobile soundproofing enclosure comprising:

a) A light weight frame;

b) A cover made out of flexible sound absorbent or sound deadening sheet material;

c) corner sound traps made with flexible sound absorptive sheet material, wherein the sound traps are independent from the booth itself and can be movably connected to the adjacent walls of the enclosure;

d) corner bars, serving to support the sound traps, which in conjunction with the sound traps can be set in various positions to allow for a plurality of user defined internal shapes of the enclosure, wherein the internal geometry of the enclosure can be changed by the user while the enclosure is fully assembled and fully functional to achieve better acoustic performance and sound diffusion;

a) a detachable ventilation noise cancelling device made with flexible sound absorbing sheet material, wherein said device can be folded away flat or in an otherwise compact manner and then easily restored to the original shape and functionality when needed.

2. A Mobile soundproofing enclosure as recited in claim 1, wherein the light weight frame has straight pieces, straight connectors and various corner connectors; wherein the frame can be assembled and disassembled by a single person and without tools.

3. Mobile soundproofing enclosure as recited in claim 2, further comprising the frame that is designed to be disassembled and reassembled multiple times as needed within as little time as 8 minutes per assembly/disassembly, and wherein the straight pieces of the frame are made of the same length and freely interchangeable.

4. Mobile soundproofing enclosure as recited in claim 2, further comprising the frame that in disassembled state is small enough to fit in a carry-on bag of 3 cubic feet in volume.

5. Mobile soundproofing enclosure as recited in claim 1 further comprising the soundproofing cover made out of flexible sound absorbent, sound deadening sheet material, or combinations thereof, that is when placed on the frame, can create a completely enclosed room or a partially enclosed screened area as defined by the specific user requirements.

6. Mobile soundproofing enclosure as recited in claim 5 further comprising the cover comprising a plurality of single wall sides, or double wall sides with air space in between the walls.

7. Mobile soundproofing enclosure as recited in claim 5 where the said plurality of walls and the top may be installed individually or in any combination to have a partially enclosed space, or all at once to achieve fully enclosed room.

8. Mobile soundproofing enclosure as recited in claim 6 where the said air space in between the double walls can be optionally filled with additional soundproofing materials at the discretion of the user, wherein such additional soundproofing material layers may be added or removed without disassembling or reconstruction of the whole enclosure.

9. Mobile soundproofing enclosure as recited in claim 5 where the cover is intended to be taken on and off as many times as needed, and, when taken off the frame, said cover can be folded for transporting or storage, in a stack small enough to fit in a shipping container of 5 cubic feet, wherein such container may be shipped by regular parcel postal service without exceeding shipping size limitations.

10. Mobile soundproofing enclosure as recited in claim 1 wherein said corner sound traps are made with flexible sound absorptive sheet material, that can be set in various positions and shapes in relation to the walls of the enclosure, to change internal geometry of the room without disturbing overall construction or functionality of the enclosure.

11. The mobile soundproof enclosure as disclosed in claim 10, wherein the corner sound traps can be placed in the said mobile soundproofing enclosure and attached to it with hooks, brackets, clips, bars or other suitable means of support for the purpose of acoustical room treatment at the discretion of the user and without structural changes to the enclosure.

12. The Mobile soundproof enclosure as described in claim 10, wherein the corner sound traps further may be supported by corner bars, wherein said corner bars can be made of any suitable material capable of supporting the sound traps, including but not limited to metal, wood, plastic, rubber, rope or string.

13. The Mobile sound proof enclosure of claim 12, wherein the corner bars comprise extendable, unfoldable or telescopic bar components that can be contracted or extended.

14. The Mobile sound proof enclosure of claim 13, wherein the corner bars further comprise swivel brackets or other means to attach to the adjacent walls of the enclosure.

15. The Mobile sound proof enclosure of claim 1 wherein the detachable ventilation noise cancelling device made with flexible sound absorbing sheet material comprises an inlet portion, a central portion and outlet portion; where the inlet portion, enters the center portion at an angle and outer portion leaves the center portion at an angle.

16. The Mobile sound proof enclosure of claim 15, wherein the ventilation noise cancelling device wherein: the center portion which is larger in diameter than the inlet portion and the outlet portion which is larger in diameter than the inlet portion.

17. The Mobile sound proof enclosure of claim 15 wherein the center portion is formed with rigid components to keep its shape open.

18. The Mobile sound proof enclosure of claim 15 wherein the ventilation noise cancelling device can be folded away flat for easy storage and transportation and then restored to its original shape and functionality when needed.

* * * * *